United States Patent [19]

Walley

[11] Patent Number: 5,013,846

[45] Date of Patent: May 7, 1991

[54] PROCESS FOR PREPARING SUBSTITUTED IMIDAZOLINE FABRIC CONDITIONING COMPOUNDS

[75] Inventor: Darlene R. Walley, Loveland, Ohio

[73] Assignee: The Procter & Gamble Company, Cincinnati, Ohio

[21] Appl. No.: 288,044

[22] Filed: Dec. 21, 1988

Related U.S. Application Data

[63] Continuation-in-part of Ser. No. 148,808, Jan. 27, 1988, abandoned.

[51] Int. Cl.[5] ..... C07D 239/06; C07D 233/04; C07D 243/04; C07D 245/02

[52] U.S. Cl. ..... 548/352; 544/335; 540/553; 540/470

[58] Field of Search ..... 548/352; 544/335; 540/470, 553

[56] References Cited

U.S. PATENT DOCUMENTS

| | | | |
|---|---|---|---|
| 3,408,361 | 10/1968 | Mannheimer | 548/352 |
| 3,681,241 | 8/1972 | Rudy | 252/8.75 |
| 3,775,316 | 11/1973 | Berg et al. | 252/8.8 |
| 4,127,489 | 11/1978 | Pracht et al. | 252/8.8 |
| 4,161,604 | 7/1979 | Elster et al. | 548/352 |
| 4,182,894 | 1/1980 | Miyamura et al. | 548/352 |
| 4,189,593 | 2/1980 | Wechsler et al. | 548/352 |
| 4,212,983 | 7/1980 | Phillips et al. | 548/352 |
| 4,233,451 | 11/1980 | Pracht et al. | 548/354 |
| 4,661,269 | 4/1987 | Trinh et al. | 252/8.8 |
| 4,709,045 | 11/1987 | Kubo et al. | 548/352 |
| 4,724,089 | 2/1988 | Konig et al. | 252/8.8 |
| 4,767,547 | 8/1988 | Straathof et al. | 252/8.8 |
| 4,770,815 | 9/1988 | Baker et al. | 252/542 |
| 4,806,255 | 2/1989 | Konig et al. | 252/8.8 |

FOREIGN PATENT DOCUMENTS

| | | |
|---|---|---|
| 1102511 | 6/1981 | Canada . |
| 0000406 | 1/1979 | European Pat. Off. . |
| 0001005 | 3/1979 | European Pat. Off. . |
| 1565808 | 4/1980 | United Kingdom . |
| 1601360 | 10/1981 | United Kingdom . |

OTHER PUBLICATIONS

J. March, *Advanced Organic Chemistry: Reactions, Mechanisms, and Structure,* McGraw Hill, New York, 1968, pp. 322–323.

R. Gabriel, "Selective Amidation of Fatty Methyl Esters with N-(2-Aminoethyl)-Ethanolamine Under Base Catalysis", *J. of Amer. Oil Chem. Soc.,* vol. 61, No. 5, 1984.

H. W. Eckert, "Condensation Products from β-Hydroxyethylene-Diamine and Fatty Acids or Their Alkyl Esters and Their Application as Textile Softeners in Washing Agents", *Fette-Seifen-Anstrichmittel* 74: 527–533, 1972.

*Primary Examiner*—John M. Ford

*Attorney, Agent, or Firm*—G. W. Allen; L. W. Lewis; R. C. Witte

[57] ABSTRACT

Disclosed is a high yield process for preparing substituted imidazoline fabric conditioning compounds. In this process, a fatty acylating agent, e.g., fatty acid, is reacted with a specific polyamine, and the product of this reaction is reacted with an esterifying agent, both reactions being conducted under specifically-defined conditions. Aqueous dispersions containing these substituted imidazoline compounds possess desirable storage stability, viscosity, and fabric conditioning properties.

15 Claims, No Drawings

PROCESS FOR PREPARING SUBSTITUTED IMIDAZOLINE FABRIC CONDITIONING COMPOUNDS

CROSS-REFERENCE TO RELATED APPLICATION

This application is a continuation-in-part of U.S. Application Ser. No. 148,808, filed Jan. 27, 1988, now abandoned.

TECHNICAL FIELD

The present invention relates to a process for preparation of substituted imidazoline fabric softening compounds. In particular, it relates to a process which results in a high yield of the desired substituted imidazoline product and minimizes the production of noncyclic amine/amide by-products. Aqueous dispersions containing these substituted imidazoline compounds possess desirable storage stability, viscosity and fabric conditioning properties and are especially suitable for use in the rinse cycle of a textile laundering operation.

BACKGROUND OF THE INVENTION

Many different types of fabric conditioning agents have been used in rinse-added textile treatment compositions. One class of compounds frequently used as the active component for such compositions, includes substantially water-insoluble quaternary nitrogenous compounds having two long alkyl chains. Typical of such materials are ditallow dimethylammonium chloride and imidazolinium compounds substituted with two tallow groups. These materials are normally prepared in the form of a dispersion in water. It is generally not possible to prepare such aqueous dispersions with more than about 10% of cationic softener without encountering severe product viscosity and storage-stability problems. Although more concentrated dispersions of softener materials can be prepared as described in European Patent Application 0,000,406, Goffinet, published Jan. 24, 1979, and United Kingdom Patent Specification 1,601,360, Goffinet, published Oct. 28, 1981, by incorporating certain nonionic adjunct softening materials therein, such compositions tend to be relatively inefficient in terms of softening benefit/unit weight of active Moreover, product viscosity and stability problems become increasingly unmanageable in more concentrated aqueous dispersions and effectively limit the commercial range of applicability to softener active levels in the range from about 15% to about 20%.

U.S. Pat. No. 2,995,520, Luvisi et al., issued Aug. 8, 1961, discloses the use of the acid salts of certain imidazoline derivatives for softening of fibrous materials such as cotton and paper. The treatment baths used for treating textiles contain from 0.001% to 1% of an acid salt of an imidazoline derivative.

More recent patents also disclose the use of an acid salt of an imidazoline derivative for the softening of fabrics. For example, U.S. Pat. No. 3,681,241, Rudy, issued Aug. 1, 1972, and U.S. Pat. No. 3,033,704, Sherrill et al., issued May 8, 1962, disclose fabric conditioning compositions containing mixtures of imidazolinium salts and other fabric conditioning agents.

Another class of nitrogenous materials that is sometimes used as the active component in rinse-added fabric softening compositions is the nonquaternary amide-amines. A commonly cited material is the reaction product of higher fatty acids with a polyamine selected from the group consisting of hydroxyalkylenediamines and dialkylenetriamines and mixtures thereof. An example of these materials is the reaction product of higher fatty acids and hydroxyethylethylenediamine (See "Condensation Products from β-Hydroxyethylethylenediamine and Fatty Acids or Their Alkyl Esters and Their Application as Textile Softeners in Washing Agents," H. W. Eckert, Fette-Seifen-Anstrichmittel, Sept. 1972, pages 527–533). These materials, along with other cationic quaternary ammonium salts and imidazolinium salts, are taught to be softening actives in fabric softening compositions. (See for example, U.S. Pat. Nos. 4,460,485, Rapisarda et al., issued July 17, 1984; 4,421,792, Rudy et al., issued Dec. 20, 1983; and 4,327,133, Rudy et al., issued Apr. 27, 1982).

The use of substituted imidazoline compounds as fabric conditioning agents is known. See for example, British Patent Specification 1,565,808, published Apr. 23, 1980. The manufacture of substituted imidazoline compounds generally involves the reaction of a polyamine with an acyl-containing material such as an acid or ester. The products of these reactions tend to be mixtures of several compounds in view of the multifunctional structure of the polyamines (see, for example, the publication by H. W. Eckert in Fette-Seifen-Anstrichmittel, cited above). That is, in addition to the imidazoline compounds formed in the described reaction, open chain mono-, di- and trialkyl species are also formed.

Recent patents also disclose processes for making substituted imidazoline compounds. For example, U.S. Pat. No. 4,233,451, Pracht, issued Nov. 11, 1980, discloses a process to form the imidazoline precursor of an imidazolinium salt by reacting acylating or esterifying agents with alkylene or polyalkylene polyamines. U S. Pat. No. 4,189,593, Wechsler et al., issued Feb. 19, 1980, discloses a process for making imidazolines involving contacting aminoethyl ethanol amine with a methyl carboxylate at elevated temperature and thereafter subjecting the reaction product to two successive heat treatments. The product imidazoline is said to be a useful starting material for making amphoteric surfactants. Japanese Laid Open Publication 61-291571 discloses a process for manufacture of 1,2-di-substituted imidazolines by reacting fatty acids or their esters with dialkylenetriamines.

It has been found that in addition to the imidazoline compounds formed in the above described reactions, noncyclic (open chain) amines/amides are also present Furthermore, it has been found that the presence of such noncyclic amines in aqueous dispersions containing substituted imidazoline fabric softening compounds can lead to lower phase stability and undesirable viscosity characteristics. Therefore, there is a need for a new and improved process for preparing substituted imidazolines that minimizes the production of noncyclic amines/amides.

It is therefore an object of the present invention to provide a process for making substituted imidazoline compounds that minimizes the production of noncyclic amine/amide by-products.

It is another object of this invention to provide a high yield process for preparing these substituted imidazoline compounds.

It is another object of this invention to provide a fabric conditioning composition comprising the substituted imidazoline compounds.

It is still another object of this invention to provide a method for conditioning fabrics by treating them with aqueous dispersions containing the desired substituted imidazoline fabric conditioning compounds.

As used herein all percentages and ratios are by weight unless otherwise specified.

SUMMARY OF THE INVENTION

The present invention encompasses a process for preparing a reaction mixture containing substituted imidazoline compounds useful as fabric conditioning agents, which process comprises:

(a) forming a liquid reaction mixture containing (1) an acylating agent selected from fatty acids of the formula RCOOH, fatty acid halides of the formula RC(O)Y, fatty acid anhydrides of the formula $(RC(O))_2O$, or fatty acid short chain esters of the formula $RC(O)OR^1$, wherein, in these formulas, R is a $C_{11}$–$C_{21}$ aliphatic hydrocarbon group, $R^1$ is a $C_1$–$C_4$ alkyl group, and Y is a halide, and (2) a polyamine having the formula $NH_2$-$(CH_2)_m$-NH-$(CH_2)_n$-X-H, wherein m and n are, independently, integers from 2 to 6, and X is O, NH. or S, the molar ratio of the acylating agent to the polyamine ranging from about 0.5:1 to 1.0:1;

(b) maintaining this liquid reaction mixture at a temperature of from about 100° C. to 240° C. for a period of time sufficient to convert at least about 50 mole percent of the polyamine in the mixture to a mono-substituted imidazoline of the formula:

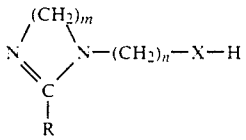

wherein R, m, n and X are as hereinbefore defined; and thereafter (c) adding to the liquid reaction mixture an esterifying agent selected from:

(i) fatty esters of the formula $R^1COOR^2$; and (ii) triglycerides of the formula:

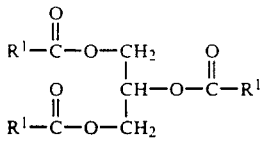

wherein, in both formulas, the $R^1$s are, independently, $C_{11}$–$C_{21}$ aliphatic groups and $R^2$ is a $C_1$–$C_4$ alkyl group;

the esterifying agent being present in an amount sufficient to provide a molar ratio of esterifying agent to acylating agent originally present of from about 0.5:1 to 1.5:1; and subsequently (d) maintaining this liquid reaction mixture at a temperature of from about 120° C. to 210° C. for a period of time sufficient to form a reaction mixture which contains one or more di-substituted imidazolines of the formula:

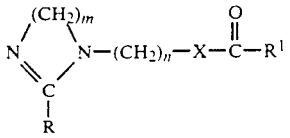

wherein R, $R^1$, m, n and X are as hereinbefore defined.

The present invention also encompasses a method of conditioning fabrics using the product formed by the above-identified reaction.

DETAILED DESCRIPTION OF THE INVENTION

In accordance with this invention, substituted imidazoline compounds are produced. The process disclosed herein results in a higher yield of the desired imidazoline compounds and a lower amount of noncyclic amine/amide by-products, compared to prior art processes for making substituted imidazoline compounds.

The process to form the desired substituted imidazoline compounds involves the following steps:

Formation of Intermediate Mono Substituted Imidazoline

The imidazoline precursor for the substituted imidazoline product is formed by reacting fatty acid acylating agents with polyalkylene polyamines, having two or three amino groups, said polyamine having a primary hydroxyl, amino, or sulfhydryl group in the $\beta$-position to a secondary amino group. The reaction is conducted at a temperature of from about 100° C. to 240° C., preferably from about 100° C. to about 210° C., more preferably from about 150° C. to about 190° C., most preferably from about 160° C. to about 180° C., for a period of time sufficient to convert at least about 50 percent of the polyamine to a mono-substituted imidazoline intermediate. More preferably at least about 75%, and most preferably at least about 90%, of the polyamine will be converted to the mono-substituted imidazoline intermediate. Reaction times needed to effect such conversion will generally range from about 2 to about 24 hours, preferably from about 5 to about 18 hours. The molar ratio of acylating agent (e.g., fatty acid) to polyamine will generally range from about 0.5:1 to about 1:1, preferably from about 0.75:1 to about 0.90:1 (acylating agent:polyamine), and under reflux or at atmospheric pressure or slightly greater. The resulting mixture contains primarily the desired intermediate imidazoline plus some of the original acylating material, some of the original polyamine, some of the noncyclized intermediate amine/amide products and other mixed reaction products.

The acylating agent preferably is a fatty acid of the formula RCOOH, where R is an $C_{11}$–$C_{21}$, preferably $C_{13}$–$C_{17}$, most preferably $C_{17}$, aliphatic hydrocarbon group. Examples of such materials include the fatty acids lauric, tridecanoic, myristic, pentadecanoic, hexadecanoic, palmitic, stearic (most preferred), and the like. Preferred fatty acids can be derived from tallow, soybean or coconut oils, and mixtures thereof.

Other acylating agents which may be used include fatty acid halides of the formula RC(O)Y, wherein Y is a halide, preferably $C_1$ or Br, fatty acid anhydrides of the formula $(RC(O))_2O$, or fatty acid short-chain esters of the formula $RC(O)OR^1$, wherein $R^1$ is a $C_1$–$C_4$ alkyl group. In all of these formulas R is a $C_{11}$–$C_{21}$, preferably $C_{13}$–$C_{17}$, aliphatic hydrocarbon group.

Examples of suitable acylating agents include, but are not limited to, the saturated fatty acids such as stearic (most preferred), lauric, tridecanoic, myristic, pentadecanoic, hexadecanoic, palmitic, behenic and the like; unsaturated fatty acids such as elaidic acid, oleic acid, linolenic acid, and the like; the fatty acid halides such as stearoyl chloride, stearoyl bromide, oleoyl chloride, palmitoyl chloride, myristoyl chloride, lauroyl chloride, and the like; the fatty acid anhydrides such as stearic anhydride, oleic anhydride, palmitic anhydride, lauric anhydride, linoleic anhydride, behenic anhydride, and the like; and the fatty acid short chain esters such as methyl laurate, methyl myristate, methyl palmitate, methyl stearate, ethyl laurate, ethyl myristate, ethyl palmitate, ethyl stearate, n-propyl laurate, n-propyl myristate, n-propyl palmitate, n-propyl stearate, isopropyl laurate, isopropyl myristate, isopropyl palmitate, isopropyl stearate, n-butyl laurate, n-butyl myristate, n-butyl palmitate, n-butyl stearate, sec-butyl laurate, sec-butyl myristate, sec-butyl palmitate, sec-butyl stearate, tert-butyl laurate, tert-butyl myristate, tert-butyl palmitate, tert-butyl stearate, and the like.

Examples of branch-chained acylating agents include, but are not limited to, 2-methyl pentadecanoic acid, 2-ethyl pentadecanoic acid, 2-methyl tridecanoic acid, 2-methyl heptadeconic acid, and the like.

Preferred fatty acids, fatty acid halides, fatty acid anhydrides, and fatty acid short chain esters can be derived from tallow, soybean oil, tall oil, coconut oils, and mixtures thereof.

The polyamine material, as indicated above, has either two or three amino groups wherein a primary hydroxyl, amino or sulfhydryl group is in the $\beta$-position to a secondary amino group. These polyamines take the following form:

$$NH_2-(CH_2)_m-NH-(CH_2)_n-X-H$$

where X is O (most preferred), NH or S, and m and n, are independently from 2 to about 6, with n=m =2 being most preferred. Examples of such polyamines include hydroxyethyl ethylenediamine and diethylenetriamine.

For illustration, the reaction of a fatty acid with a polyamine to form the intermediate imidazoline can be diagrammed as follows:

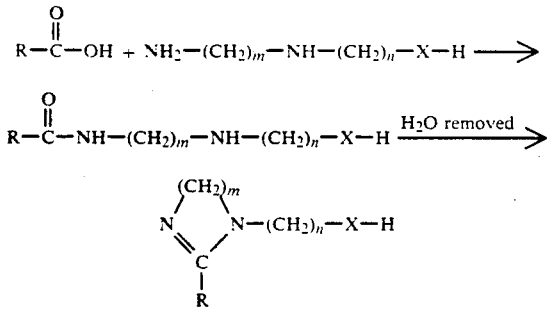

II wherein R is a $C_{11}$–$C_{21}$ aliphatic hydrocarbon group, m and n are independently from 2 to about 6, and X is O, NH, or S.

Optionally, the reaction yield can be improved by removal of water and excess polyamine via incorporation of distillation apparatus in the set-up Preferably, a vacuum of from about 0.02 mm Hg to about 10 mm Hg is drawn for a period from about 1 hour to about 6 hours at a temperature of from about 125° C. to about 185° C., to facilitate the removal of the excess polyamine and water as well as any noncyclic amine/amide by-products.

Preferably the reaction mixture is rendered in liquid form by heating the reactants above their melting point and by combining the reactants in their molten state. Optionally, but not preferably, the liquid reaction mixture may also contain solvents known by those skilled in the art to be compatible with the reactants in the liquid reaction mixture. Examples of said solvents include, but are not limited to, water, aliphatic hydrocarbons, aromatic hydrocarbons, (e.g., benzene, xylene, etc.), amines, nitriles, halocarbons (e.g., chlorocarbons), ethers, and glymes. Accordingly, the reaction mixture will generally contain from about 50% to 100% by weight, more preferably from about 75% to 100% by weight, of the reactants. Use of components other than the reactants in the initially formed reaction mixture is not preferred since such non-reactive ingredients may impact reaction conditions as a result of their presence. The initial reaction mixture, which may or may not be anhydrous, is preferably formed by charging a suitable reaction vessel with liquid (e.g., molten) polyamine and by then adding the molten acylating agent to the vessel while agitating, e.g. stirring, the reaction mixture.

B. Addition of Second Long Chain Alkyl or Substituted Alkyl Group

As described above (Step A), the formation of the intermediate mono-substituted imidazoline is accomplished by reacting a polyamine with an acylating agent. The intermediate imidazoline formed has the formula:

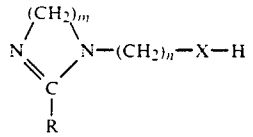

II wherein R, X, m and n are as defined above.

The intermediate imidazoline (II) formed only has a long chain group of the type desired at the 2 position, rather than at both the 1 and 2 positions of the imidazoline ring. In order to attach a long chain aliphatic hydrocarbon group to the 1 position, the mono-substituted imidazoline (II) is reacted further with a fatty acid-based esterifying agent. The molar ratio of the esterifying agent (e.g., fatty acid ester) in this step to the mono-acylating agent (e.g., fatty acid) used in the formulation of the mono-substituted imidazoline (Step A) ranges from about 0.5:1 to about 1.5:1, preferably from about 0.75:1 to about 1.2:1 (esterifying agent:fatty acid), and the reaction time ranges from about 1 to about 24 hours, preferably from about 5 to about 22 hours, at a temperature of from about 120° C. to about 210° C., preferably from about 165° C. to about 190° C., under a vacuum of from about 0.02 to about 10 mm of mercury, preferably from about 0.2 mm to about 2.0 mm Hg.

Examples of esterifying agents useful herein include fatty acid esters of the formula $R^1COOR^2$, where RI is an $C_{11}$–$C_{21}$, preferably $C_{13}$–$C_{17}$, most preferably $C_{17}$ aliphatic hydrocarbon group, and $R^2$ is a $C_1$–$C_4$, preferably $C_1$–$C_2$, most preferably $C_1$ (i.e., methyl) alkyl group. Examples of such materials include the $C_1$–$C_4$ esters of lauric, tridecanoic, myristic, pentadecanoic, hexadecanoic, palmitic, oleic, and stearic fatty acids; with the methyl esters being preferred. Preferred fatty acid methyl esters can be derived from tallow, soybean or coconut oils, and mixtures thereof.

Another type of esterifying agent useful herein includes esters of polyhydric alcohols, such as mono-, di-, and tri-glycerides. Of the glycerides, the tri-glycerides are most preferred and have the general formula:

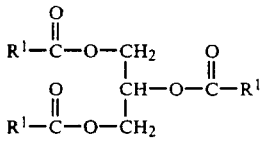

wherein $R^1$ is a $C_{11}$–$C_{21}$ aliphatic hydrocarbon group.

Examples of tri-glycerides include fats and oils derived from tallow, soybean, coconut, cottonseed, sunflower seed, safflower seed, canola, as well as fish oils, and tall oils. The hydrogenated (hardened) derivatives of these fats and oils are also suitable.

Examples of suitable di-glycerides include both the 1,3-di-glycerides and the 1,2-di-glycerides, preferably di-glycerides containing two $C_{12}$–$C_{22}$, most preferably $C_{16}$–$C_{20}$, aliphatic hydrocarbon groups, including glycerol-1,2-dilaurate; glycerol-1,3-dilaurate; glycerol-1,2-dipalmitate; glycerol-1, 3-dipalmitate; glycerol-1,2-distearate, glycerol-1,3-distearate, glycerol-1,2-ditallowalkyl and glycerol-1,3-ditallowalkyl.

Examples of suitable mono-glycerides include glycerol-1-monolaurate, glycerol-2-monolaurate, glycerol-1-monomyristate, glycerol-2-monomyristate, glycerol-1-monopalmitate, glycerol-2-monopalmitate, glycerol-1-monostearate, and glycerol-2-monostearate.

By way of illustration, the reaction of the intermediate imidazoline (II) formed in step A with the alkyl ester of a fatty acid to form the desired substituted imidazoline compounds can be diagrammed as follows:

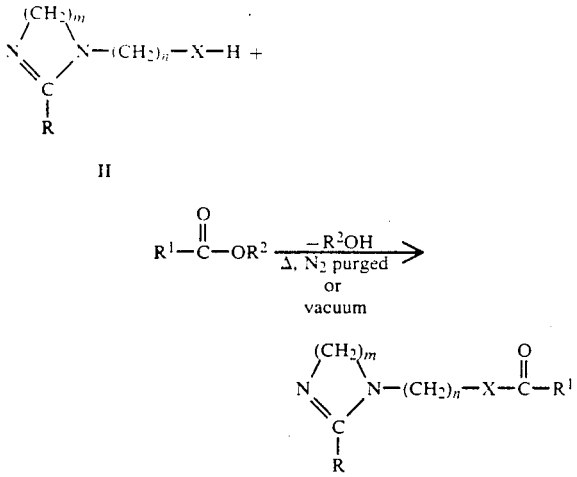

wherein R and $R^1$ are, independently, $C_{11}$–$C_{21}$ aliphatic hydrocarbon groups, $R^2$ is $C_1$–$C_4$ alkyl, and m and n are, independently, from 2 to about 6, and X is O, NH, or S.

By the way of further illustration, the reaction of the intermediate imidazoline (II) formed in step A with a triglyceride esterifying agent to form the desired substituted imidazoline compounds can be diagrammed as follows:

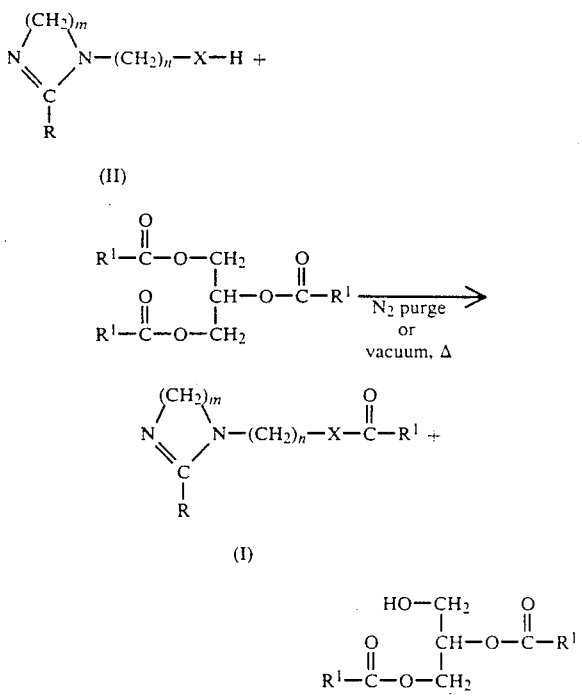

The above reactions provide a high yield of the desired substituted imidazoline fabric conditioning compounds (I). Preferred are those imidazoline compounds wherein R and $R^1$ are independently $C_{13}$ to $C_{17}$ alkyl groups (e.g., wherein R and $R^1$ are derived from palmityl or stearyl). Most preferred are those imidazoline compounds wherein R and $R^1$ are each $C_{17}$ alkyl groups (e.g., wherein R is derived from stearic acid, and $R^1$ is derived from methyl stearate).

Examples of such imidazoline compounds wherein X is O (oxygen) include stearyl oxyethyl-2-stearyl imidazoline, stearyl oxyethyl-2-palmityl imidazoline, stearyl oxyethyl-2-myristyl imidazoline, palmityl oxyethyl-2-palmityl imidazoline, palmityl oxyethyl-2-myristyl imidazoline, stearyl oxyethyl-2-tallow imidazoline, myristyl oxyethyl-2-tallow imidazoline, palmityl oxyethyl-2-tallow imidazoline, coconut oxyethyl-2-coconut imidazoline, tallow oxyethyl-2-tallow imidazoline, and mixtures of such imidazoline compounds.

Examples of such imidazoline derivatives wherein X is NH include stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut amido ethyl-2-coconut imidazoline, tallow amido ethyl-2-tallow imidazoline, and mixtures of such imidazoline compounds.

Examples of such imidazoline derivatives wherein X is S (sulfur) include stearylthiolethyl-2-stearyl imidazoline, stearylthiolethyl-2-palmityl imidazoline, stearylthiolethyl-2-myristyl imidazoline, palmitylthiolethyl-2-palmityl imidazoline, palmitylthiolethyl-2-myristyl imidazoline, palmitylthiolethyl 2-tallow imidazoline, myristylthiolethyl-2-tallow imidazoline, stearylthiolethyl-2-tallow imidazoline, coconutthiolethyl-2-coconut imidazoline, tallowthiolethyl-2-tallow imidazoline, and mixtures of such compounds.

Without intending to be bound by theory, it is believed that the high yield of the desired substituted imidazoline compounds is a result of dividing the reaction into 2 steps (for selectivity), keeping temperatures to a minimum in step B while reducing pressure, and keeping the reaction times in both steps to a minimum. Importantly, the process disclosed herein for preparing these substituted imidazoline compounds also minimize the production of noncyclic amine/amide by-products, thereby improving the stability, viscosity and fabric conditioning properties of aqueous dispersions containing these compounds.

The process for preparing substituted imidazoline fabric conditioning compounds of the present invention through the use of a fatty acid ester esterifying agent can be illustrated as follows using $\beta$-hydroxyethylenediamine as the polyalkylene polyamine and the methyl ester of a fatty acid as the esterifying agent:

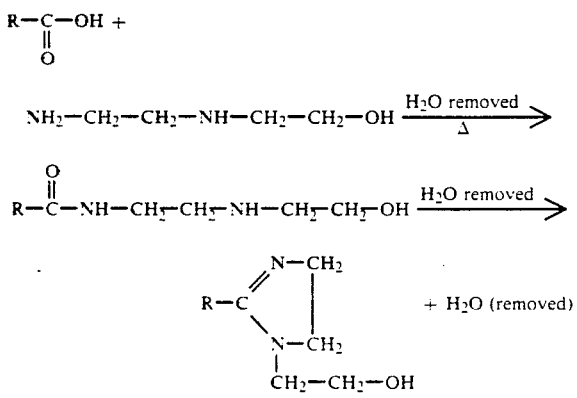

where R is an aliphatic hydrocarbon group containing from about 11 to about 21 carbon atoms.

The primary alcohol present in the imidazoline formed above then is converted to an ester in order to attach the second long chain hydrocarbon group $R^1$ in the following manner:

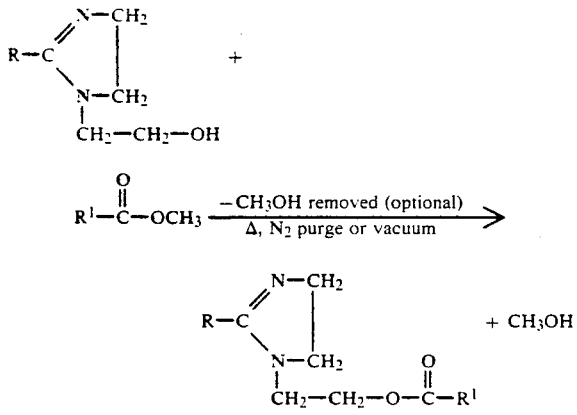

where $R^1$ is an aliphatic hydrocarbon group containing from about 11 to about 21 carbon atoms. It should be appreciated that the structure of the substituted imidazoline compound formed depends on the choice and concentration of polyamine and acylating or esterifying agent. For example, if the polyamine used is diethylenetriamine, then the structure of the substituted imidazoline formed would be

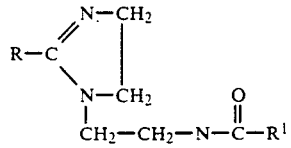

where R and $R^1$ are as defined above.

The reaction product of the above described reaction will also contain minor amounts of noncyclic amine/amide by-products such as

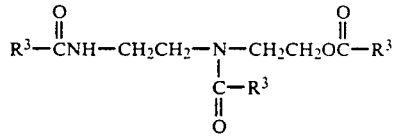

(i)

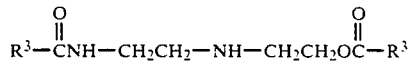

(ii)

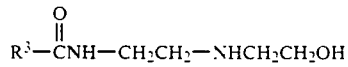

(iii)

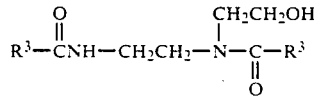

(iv)

where $R^3$ is a $C_{11}$-$C_{21}$ aliphatic hydrocarbon group (note the source of $R^3$ can be either from the long chain alkyl fatty acid, RCOOH, or the methyl ester of a fatty acid, $R^1COOCH_3$). Some of the noncyclic amine/amides shown above, as well as some of the starting materials, other intermediates, water and other complexes are present in the reaction product as diluents along with the desired substituted imidazoline. Most of the diluents are removed during the vacuum stages of the reaction. Importantly, the above preparation method results in a high yield of the desired substituted imidazoline products and minimizes the production of noncyclic amine/amide by-products, thereby eliminating the need to separate components. That is, the final reaction product can be used "as is" in formulating fabric conditioning compositions.

FABRIC CONDITIONING COMPOSITIONS

Fabric conditioning compositions containing the substituted imidazoline compounds prepared herein are especially suitable for use in the rinse cycle of a textile laundering operation. Said compositions should contain less than about 50%, preferably less than about 20%, of uncyclized amine/amide by-products, based on the weight of the desired substituted imidazoline compounds. The process described herein will yield the desired imidazoline compounds and ensure that the compositions will not have more than the above-indicated levels of the various undesirable compounds. As indicated earlier, the imidazoline compounds of interest herein have the formula:

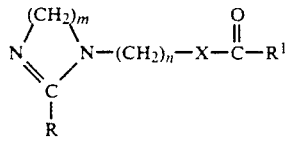

I wherein R and $R^1$ are, independently, $C_{11}$–$C_{21}$ aliphatic hydrocarbon groups, and m and n are, independently, from 2 to about 6, and X is O, NH, or S.

The fabric conditioning compositions are preferably aqueous and contain from about 1% to about 25% of the reaction product produced by the process disclosed herein (i.e., comprising primarily the substituted imidazoline compounds of formula (I)). However, the compositions preferably contain from about 1% to about 15%, and most preferably from about 2% to about 8%, of the reaction product of the present invention.

Alternatively, solid fabric softening and antistatic compositions can be prepared from the reaction product mixtures produced by the process of this invention. Such solid compositions can be releasably affixed to a solid carrier. As an example, such compositions can be releasably affixed onto a sheet (e.g., paper towel, nonwoven fabric, or the like) and tumbled with damp fabrics in a hot-air clothes dryer, in the manner of the BOUNCE® brand dryer-added product known in commercial practice. Generally, such solid form compositions will comprise from about 50% to about 100% of the reaction product mixture produced by the process of the instant invention.

In addition to the preferred substituted imidazolinium compounds, the fabric conditioning compositions of the present invention may also contain other fabric conditioning (softening/antistatic) agents. Such other agents may be described as cationic and nonionic organic materials which are generally employed as fabric conditioning agents during the rinsing cycle of the household laundering process. They are organic, waxy materials having a melting (or softening) point between 25° C. and 115° C. Such materials possess both fabric softening and fabric antistat properties.

Conventional Cationic Nitrogen-Containing Fabric Conditioning Compounds

Generally, the conventional cationic nitrogen-containing compounds such as quaternary ammonium compounds have one or two straight-chain organic groups of at least eight carbon atoms. Preferably, they have one or two such groups of from 12 to 22 carbon atoms. Preferred cation-active softener compounds include the quaternary ammonium antistat-softener compounds corresponding to the formula:

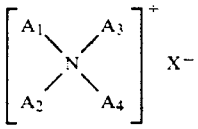

(III)

wherein $A_1$ is hydrogen or an aliphatic group of from 1 to 22 carbon atoms; $A_2$ is an aliphatic group having from 12 to 22 carbon atoms; $A_3$ and $A_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic antistatic/softener compounds are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $A_1$ and $A_2$ have predominantly from 16 to 18 carbon atoms. The term "coconut" refers to fatty acid groups from coconut oil fatty acids. The coconut-alkyl $A_1$ and $A_2$ groups have from about 8 to about 18 carbon atoms and predominate the $C_{12}$ to $C_{14}$ alkyl groups. Representative examples of quaternary softeners of the invention include ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; and di(coconut-alkyl) dimethyl ammonium chloride.

Another preferred class of fabric conditioning compounds are mono-ester analogs of the quaternary ammonium antistat/softener of formula (III), wherein X is as hereinbefore defined; $A_1$ and $A_2$ are, independently, short-chain ($C_1$–$C_6$, preferably $C_1$–$C_3$) alkyl or hydroxyalkyl substituents; $A_4$ is a long-chain hydrocarbon substituent in the $C_{16}$–$C_{18}$ range, preferably $C_{18}$ alkyl, most preferably straight-chain alkyl; and $A_3$ is a long-chain esterified substituent of the formula:

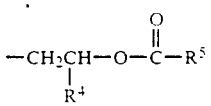

wherein $R^4$ is hydrogen (preferred), a hydroxyl, group or a short-chain ($C_1$–$C_4$) alkyl group, especially methyl, and $R_5$ is a long-chain alkyl substituent in the $C_{13}$–$C_{17}$ range, preferably $C_{15}$ straight-chain alkyl.

As illustrative, nonlimiting examples there can be mentioned the following:

$[CH_3]_2[C_{18}H_{37}]+NCH_2CH(CH_3(OC(O)C_{15}H_{31}Br$ $[C_2H_5]_2[C_{17}H_{35}]^+NCH_2CH_2OC(O)C_{13}H_{27}Cl$ $[C_2H_5][CH_3][C_{18}H_{37}]^-NCH_2CH_2OC(O)C_{14}H_{29}CH_3SO_4$ $[C_3H_7][C_2H_5][C_{16}H_{33}]^-NCH_2CH_2OC(O)C_{15}H_{31}Cl$ $[iso\text{-}C_3H_7][CH_3][C_{18}H_{37}]^-NCH_2CH_2OC(O)C_{15}H_{31}I$ $[CH_3]_2[C_{18}H_{37}]^-NCH_2CH(OH)CH_2OC(O)C_{15}H_{31}Cl$ $[C_2H_5]_2[C_{17}H_{35}]^-NCH_2CH(OH)CH_2OC(O)C_{14}H_{29}CH_3SO_4$ An especially preferred class of quaternary ammonium antistat/softeners correspond to the formula:

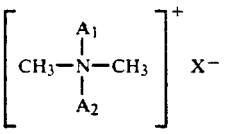

wherein $A_1$ and $A_2$ are each straight chain aliphatic groups of from 12 to 22 carbon atoms and X is halogen (e.g., chloride) or methyl sulfate. Especially preferred are ditallow dimethyl ammonium chloride and di(hydrogenated tallow) dimethyl ammonium chloride and di(coconut) dimethyl ammonium chloride, these compounds being preferred from the standpoint of excellent softening properties and ready availability.

Other examples of conventional quaternary ammonium salts include:

(i) diamido quaternary ammonium salts having the formula:

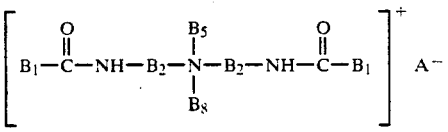

wherein $B_1$ is an acyclic aliphatic $C_{15}$–$C_{22}$ hydrocarbon group, $B_2$ is a divalent alkylene group having 1 to 3 carbon atoms, $B_5$ and $B_8$ are $C_1$–$C_4$ saturated alkyl or hydroxyalkyl groups, and A is an anion;

(ii) diamido alkoxylated quaternary ammonium salts having the formula:

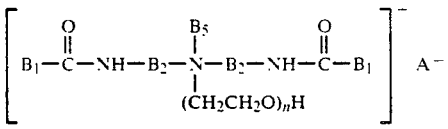

wherein n is equal to from about 1 to about 5, and $B_1$, $B_2$, $B_5$ and A are as defined above;

(iii) quaternary imidazolinium compounds having the formula:

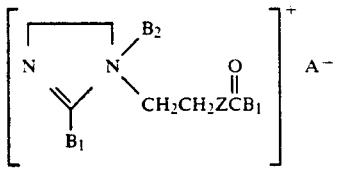

wherein $B_1$=$C_{15}$–$C_{17}$ saturated alkyl, $B_2$=$C_1$–$C_4$ saturated alkyl or H, Z=NH or O, and A is an anion.

Examples of Components (i) and (ii) are methylbis(tallowamidoethyl) (2-hydroxyethyl) ammonium methylsulfate and methylbis(hydrogenated tallowamidoethyl) (2-hydroxyethyl) ammonium methylsulfate, wherein $B_1$ is an acyclic aliphatic $C_{15}$–$C_{17}$ hydrocarbon group, $B_2$ is an ethylene group, $B_5$ is a methyl group, $B_8$ is a hydroxyalkyl group and A is a methylsulfate anion; these materials are available from Sherex Chemical Company under the trade names Varisoft® 222, and Varisoft® 110, respectively.

Examples of Component (iii) are 1-methyl-1-tallowaminoethyl-2-tallowimidazolinium methylsulfate and 1-methyl-1-(hydrogenated tallowamidoethyl)-methylsulfate.

Nonionic fabric antistat/softener materials include a wide variety of materials including sorbitan esters, fatty alcohols and their derivatives, and the like. One preferred type of nonionic fabric antistat/softener material comprises the esterified cyclic dehydration products of sorbitol, i.e., sorbitan ester. Sorbitol, itself prepared by catalytic hydrogenation of glucose, can be dehydrated in well-known fashion to form mixtures of cyclic 1,4-and 1,5-sorbitol anhydrides and small amounts of isosorbides. (See Brown: U.S. Pat. No. 2,322,821; issued June 29, 1943). The resulting complex mixtures of cyclic anhydrides and sorbitol are collectively referred to herein as "sorbitan". It will be recognized that this "sorbitan" mixture will also contain some free uncyclized sorbitol.

Sorbitan ester fabric antistat/softener materials useful herein are prepared by esterifying the "sorbitan" mixture with a fatty acyl group in standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mono-, di-, tri-, and tetra-esters almost always result from such reactions, and the stoichiometric ratios of the reactants can simply be adJusted to favor the desired reaction product.

The foregoing complex mixtures of esterified cyclic dehydration products of sorbitol (and small amounts of esterified sorbitol) are collectively referred to herein as "sorbitan esters". Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful fabric antistat/softener materials in the context of the present invention.

The preferred alkyl sorbitan ester fabric antistat/softener materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters and the mixed tallowalkyl sorbitan mono- and di-esters. The tri-and tetra-esters of sorbitan with lauric, myristic, palmitic, stearic and behenic acids, and mixtures thereof, are also useful herein.

Another useful type of nonionic fabric antistat/softener material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides) are useful herein, inasmuch as all such materials are fabric substantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as a fabric antistat/softener material in the instant invention encompasses various esters of polyhydric alcohols. Note that in this context these esters of polyhydric alcohols are merely additives to the fabric softening composition and are not reactants used in the synthesis of the imidazoline softener active. Such "ester-alcohol" materials which have a melting point within range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1, 2-dipalmitate; glycerol-1,3-dipalmitate; glycerol-1,2-distearate and glycerol-1,3-distearate. Mixed glycerides available from mixed tallowalkyl fatty acids, i.e., glycerol-1,2-ditallowalkyl and glycerol-1,3-ditallowalkyl , are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free -OH group, also fall within the definition of alcohols useful as fabric antistat/softener materials herein. The ether-alcohols can be prepared by the classic Williamson ether synthesis. As with the ester-alcohols, the reaction conditions are chosen such that at least one free, unetherified -OH group remains in the molecule.

Ether-alcohols useful herein include glycerol-1,2-dilauryl ether; glycerol-1,3-distearyl ether; and butane tetra-ol-1,2,3-trioctanyl ether.

The fabric antistat/softeners described above, when present in the compositions of the present invention, are normally present in amounts ranging from about 1% to 12% by weight of the composition, preferably from about 1% to about 8%. Preferred mixtures are mixtures of the substituted imidazoline compound (I) with a sorbitan ester, a fatty alcohol, or a quaternary ammonium compound. A most preferred mixture is the substituted imidazoline compound (I) with a mono-ester analog of quaternary ammonium compounds containing 2 short chain alkyl or hydroxyalkyl substituents, one long chain aliphatic hydrocarbon substituent, and a long chain esterified hydrocarbon substituent optionally containing hydroxy alkyl branches. These two compounds are preferably used in a weight ratio of from about 80/20 to about 20/80 and most preferably in a weight ratio of from 70/30 to 30/70 imidazoline/DTDMAC.

Other Optional Ingredients

Adjuvants can be added to the compositions herein for their known purposes. Such adjuvants include, but are not limited to, viscosity control agents, perfumes, emulsifiers, preservatives, antioxidants, bactericides, fungicides, colorants, dyes, brighteners, opacifiers, freeze-thaw control agents, shrinkage control agents, and agents to provide ease of ironing. These adjuvants, if used, are added at their usual levels, generally up to about 5% each by weight of the composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm, by weight of the composition.

Examples of bactericides used in the compositions of this invention are glutaraldehyde, formaldehyde, 2-bromo-2-nitropropane-1,3-diol sold by Inolex Chemicals under the trade name Bronopol ®, and a mixture of 5-chloro-2-methyl-4-isothiazoline -3-one and 2-methyl-4-isothiazoline-3-one sold by Rohm and Haas Company under the trade name Kathon ® CG/ICP. Typical levels of bactericides used in the present compositions are from about 1 to about 1,000 ppm by weight of the composition.

Examples of antioxidants that can be added to the compositions of this invention are propyl gallate, available from Eastman Chemical Products, Inc., under the trade names Tenox ® PG and Tenox ® S-1, and butylated hydroxy toluene, available from UOP Process Division under the trade name Sustane ® BHT.

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the softener compositions in a preemulsified form which is obtainable directly from the suppliers. Examples of these preemulsified silicones are 60% emulsion of polydimethylsiloxane (350 cs) sold by Dow Corning Corporation under the trade name Dow Corning ® 1157 Fluid, and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

Other minor components include short chain alcohols such as ethanol and isopropanol which are present in the commercially available quaternary ammonium compounds used in the preparation of the present compositions. The short chain alcohols are normally present at from about 1% to about 10% by weight of the composition.

A preferred composition contains from about 0.2% to about 2% of perfume, from 0% to about 3% of polydimethylsiloxane, from 0% to about 0.4% of calcium chloride, from about I ppm to about 1,000 ppm of bactericide, from about 10 ppm to about 100 ppm of dye, and from 0% to about 10% of short chain alcohols, by weight of the total composition.

The pH of the compositions of this invention is generally adjusted to be in the range of from about 2 to about 9, preferably from about 2.5 to about 5. Adjustment of pH is normally carried out by including a small quantity of free acid in the formulation. Because no strong pH buffers are present, only small amounts of acid are required. Any acidic material can be used; its selection can be made by anyone skilled in the softener arts on the basis of cost, availability, safety, etc. Among the acids that can be used are hydrochloric, sulfuric, phosphoric, citric, maleic, and succinic. For the purposes of this invention, pH is measured by a glass electrode in a full strength softening composition.

Processing

The aqueous fabric conditioning compositions herein can be prepared by adding the reaction product of the present invention (i.e., substituted imidazoline fabric softening compounds (I)) to water using conventional techniques. A convenient and satisfactory method is to first mix the substituted imidazoline compounds, prepared by the process herein, with isopropanol. The mixture is heated to a temperature of from about 60° C. to about 90° C. to form a fluidized "melt". The melt is poured into water (heated from about 50° C. to about 75° C.) and mixed with high shear mixing to form an aqueous dispersion. The composition is then adjusted to a pH of from about 2 to about 9, preferably from about 2.5 to 5. Optional ingredients can be added according to methods known in the art.

Composition Usage

In the method aspect of this invention, fabrics or fibers are contacted with an effective amount, generally from about 20 mi to about 200 ml (per 3.5 kg of fiber or fabric being treated), of the compositions herein in an aqueous bath. Of course, the amount used is based upon the judgment of the user, depending on concentration of the composition, fiber or fabric type, degree of softness desired, and the like. Typically, about 120 mls of a 5% dispersion of the substituted imidazoline softening compounds are used in a 25 1 laundry rinse bath to soften and provide antistatic benefits to a 3.5 kg load of mixed fabrics. Preferably, the rinse bath contains from about 25 ppm to about 100 ppm of the fabric softening compositions herein. These concentration levels achieve superior fabric softening and static control.

In general, the invention herein in its fabric conditioning method aspect comprises: (a) washing fabrics in a conventional automatic washing machine with a detergent composition (normally containing a detersive surfactant or mixture of surfactants selected from the group consisting of anionic, nonionic, amphoteric or ampholytic surfactants); (b) rinsing the fabrics; and (c) adding during the rinse stage of the operation the above-described levels of the fabric conditioning agents. An alternative to step (c) is treating damp fabrics with a solid fabric softening composition releasably affixed to a carrier substrate in an automatic dryer at a temperature of at least about 38° C. It is noted that the dryer may be utilized to dry fabrics whether the fabric softening composition is applied to the fabrics through an aqueous dispersion or in a solid form, and is the preferred method of drying as it facilitates spreading of the fabric conditioning materials herein across the fabric surfaces.

The following exemplify the various synthesis, compositional and method of use aspects of the present invention. These examples are merely illustrative of the invention and should not be considered as limiting. de

EXAMPLE I

A substituted imidazoline ester fabric conditioning compound is prepared in the following manner:

208.3 g (2.0 moles) of β-hydroxethylethylenediamine (aminoethylamine ethanol) are placed in a 3-necked 2 liter flask along with 426.8 g (1.5 moles) of stearic acid. The flask is sparged with argon and equipped with a reflux condenser, distillation apparatus and overhead stirrer. The reaction mixture is then heated to 165° C. for 18 hours. Next, a vacuum of approximately 0.2 mm Hg is drawn for 4 hours, at a temperature of 165° C., during which time water and excess amine are collected. The reaction mixture is cooled to 120° C. and 447.8 g (1.5 moles) of methyl stearate is added. Reaction temperature is increased to 170° C. at which time the reaction flask is subjected to a vacuum of approximately 0.2 mm Hg for 22 hours. The above reaction produces a high yield of stearyloxyethyl-2-stearyl imidazoline and minimizes the amount of noncyclic amine/amide by-products.

EXAMPLE II

A substituted imidazoline ester fabric conditioning compound is prepared in the following manner:

208.3 g (2.0 moles) of β-hydroxyethylenediamine (aminoethylamino ethanol) is placed in a 3-necked 2 liter flask along with 384.7 g (1.5 moles) of palmitic acid. The flask is sparged with argon and equipped with a reflux condenser, distillation apparatus and overhead stirrer. The reaction mixture is then heated to 180° C. for 6 hours. Next, a vacuum of approximately 0.2 mm Hg is drawn for 4 hours, at a temperature of 180° C., during which time water and excess amine are collected. The reaction mixture is cooled to 120° C. and 405.7 g (1.5 moles) of methyl palmitate is added. Reaction temperature is increased to 180° C. at which time the reaction flask is subjected to a vacuum of approximately 0.2 mm Hg for 12 hours. The above reaction produces a high yield of palmityloxyethyl-2-palmityl imidazoline and minimizes the amount of noncyclic amine/amide by-products.

EXAMPLE III

A substituted imidazoline ester fabric conditioning compound is prepared in the following manner:

208.3 g (2.0 moles) of β-hydroxyethylenediamine (aminoethylamine ethanol) are placed in a 3-necked 2 liter flask along with 342.6 g (1.5 moles) of myristic acid. The flask is sparged with argon and equipped with a reflux condenser, distillation apparatus and overhead stirrer. The reaction mixture is the heated to 170° C. for 12 hours. Next, a vacuum of approximately 0.2 mm Hg is drawn for 4 hours, at a temperature of 170° C., during which time water and excess amine are collected. The reaction mixture is cooled to 120° C. and 363.6 g (1.5 moles) of methyl myristate is added. Reaction temperature is increased to 170° C. at which time the reaction flask is subjected to a vacuum of approximately 0.2 mm Hg for 18 hours. The above reaction produces a high yield of myristyloxyethyl-2-myristyl imidazoline and minimizes the amount of noncyclic amine/amide by-products.

EXAMPLE IV

A substituted imidazoline ester fabric conditioning compound is prepared in the following manner:

624.9 g (6.0 moles) of β-hydroxyethylenediamine (aminoethylamino ethanol) is placed in a 3-necked 2 liter flask along with 1,137.9 g (4.0 moles) of stearic acid. The flask is sparged with and equipped with a reflux condenser, distillation apparatus and overhead stirrer. The reaction mixture is then heated to 165° C. for 18 hours. Next, a vacuum of approximately 0.2 mm Hg is drawn for 4 hours, at a temperature of 165° C., during which time water and excess amine are collected. The reaction mixture is cooled to 120° C. and 1081.9 g (4.0 moles) of methyl palmitate is added. Reaction temperature is increased to 170° C. at which time the reaction flask is subjected to a vacuum of approximately 2 mm Hg for 20 hours. The above reaction produces a high yield of palmityloxyethyl-2-stearyl imidazoline and minimizes the amount of noncyclic amine/amide by-products.

EXAMPLE V

A substituted imidazoline amide fabric conditioning compound is prepared in the following manner:

206.4 g (2.0 moles) of diethylenetriamine is placed in a 3-necked 2 liter flask along with 426.8 g (1.5 m stearic acid. The flask is sparged with argon and equipped with a reflux condenser, distillation apparatus and overhead stirrer. The reaction mixture is then heated to 165° C. for 6 hours. Next, a vacuum of approximately 0.2 mm Hg is drawn for 2 hours, at a temperature of 165° C., during which time water and excess amine are collected. The reaction mixture is cooled to 120° C. and 447.8 g (1.5 moles) of methyl stearate is added. Reaction temperature is increased to 170° C. at which time the reaction flask is subjected to a vacuum of approximately 0.2 mm Hg for 12 hours. The above reaction produces a high yield of 1-stearylamidoethyl-2-stearyl imidazoline and minimizes the amount of noncylic amine/amide by-products.

EXAMPLE VI

A substituted imidazoline thiol fabric conditioning compound is prepared in the following manner:

240.4 g (2.0 moles) of aminoethylamino thiol is placed in a 3necked 2 liter flask along with 426.8 g (1.5 moles) of stearic acid. The flask is sparged with argon and equipped with a reflux condenser, distillation apparatus and overhead stirrer. The reaction mixture is then heated to 170° C. for 18 hours. Next, a vacuum of approximately 0.2 mm Hg is drawn for 4 hours, at a temperature of 170° C., during which time water and excess amine are collected. The reaction mixture is cooled to 120° C. and 447.8 g (1.5 moles) of methyl stearate is added. Reaction temperature is increased to 185° C. at which time the reaction flask is subjected to a vacuum of approximately 2 mm Hg for 20 hours. The above reaction produces a high yield of 1-stearylthiolethyl-2-stearyl imidazoline and minimizes the amount of noncyclic amine/amide by-products.

EXAMPLE VII

A substituted imidazoline ester fabric conditioning compound is prepared in the following manner:

114.6 g (1.1 moles) of β-hydroxyethylenediamine (aminoethylamino ethanol) is placed in a 3-necked 2 liter flask along with 284.5 g (1.0 mole) of stearic acid. The flask is sparged with nitrogen and equipped with a refleux condenser, distillation apparatus and overhead stirrer. The reaction mixture is then heated to 165° C. for 18 hours. Next, a vacuum of approximately 0.2 mmHg is drawn for 4 hours, at a temperature of 165° C., during which time water and excess amine are collected. The reaction mixture is cooled to 120° C. and 303.1 g (0.34 mole) of tristearyl glycerine is added. Reaction temperature is increased to 170° C., at which time the reaction flask is subjected to a vacuum of approximately 2 mmHg for 20 hours. The above reaction produces a high yield of stearoyloxyethyl-2-stearyl imidazoline and minimizes the amount of noncyclic amine/amide by-products.

Substantially similar results are obtained in Examples I–VII when the processing conditions such as temperatures, reaction times, pressures, etc. are varied according to the limitations contained herein.

EXAMPLE VIII

The preparation of a liquid fabric softener composition for use in the rinse cycle of a standard laundering operation is as follows:

| Ingredient | Percent (wt.) |
|---|---|
| Stearyloxyethyl-2-stearyl Imidazoline* | 4.5% |
| Isopropanol | 0.6% |
| 0.1N HCL | 0.25% |
| Water | Balance |

*Reaction product of Example I.

The preparation of the fabric softening composition of Example VIII is carried out as follows: 18 g of the imidazoline fabric conditioning compound and 2.4 g of isopropanol are mixed and heated to 75° C. to form a fluidized "melt". The melt is then poured into a 375 g water seat with high shear mixing. The water is preheated to 70° C. The dispersion is mixed for 15 minutes at 7000 rpm (Tekmar® high shear mixer). The pH is adJusted to 4 by the addition of 1 ml of 0.1 N HCl. The resulting composition has a viscosity of 40 centipoise (at 25° C.) and is used in standard fashion as a rinse-added fabric softener. When multiple rinses are used, the fabric softening composition is preferably added to the final rinse. The amount added to the rinse cycle is generally from about 20 ml to about 200 ml (per 3.5 kg of fabric being treated).

Substantially similar results are obtained if the stearyloxyethyl-2-stearyl imidazoline in the above example is replaced, in whole or in part, with the reaction products prepared in Examples II–VII.

EXAMPLE IX

A dryer-additive sheet is prepared by warming 3 grams of reaction product mixture from any of the above Examples in 6 grams of isopropyl alcohol to prepare a melt in the manner of Example VIII. The melt is evenly spread onto and into an ordinary, disposable non-woven rayon sheet (20 cm ×20 cm) and allowed to dry. In use, the impregnated sheet is commingled and tumbled with wet fabrics (5 kg load of fabrics, dry weight basis) in a standard hot air clothes dryer until the fabrics are dry, to provide a soft, antistatic finish.

What is claimed is:

1. A process for making a substituted imidazoline compound having the formula:

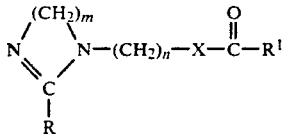

wherein R and $R^1$ are, independently, $C_{11}$-$C_{21}$ aliphatic hydrocarbon groups, and m and n are, independently, from about 2 to about 6, and X is O, NH, or S, said process comprising the following steps:

(a) reacting a fatty acid of the formula RCOOH, where R is a $C_{11}$-$C_{21}$ aliphatic hydrocarbon group, with a polyamine having the formula $NH_2$-$(CH_2)_m$—NH—$(CH_2)_n$—X—H, wherein m and n are, independently, from about 2 to about 6, and X is O, NH, or S, for a period of from about 2 to about 24 hours at a temperature of from about 100° C. to about 210° C., the molar ratio of the fatty acid to the polyamine being from about 0.5:1 to about 1:1 (fatty acid: polyamine); and (b) reacting the ester of a fatty acid having the formula $R^1COOR^2$, wherein $R^1$ is a $C_{11}$-$C_{21}$ aliphatic hydrocarbon group and $R^2$ group is a $C_1$-$C_4$ alkyl group, with the mixture formed in step (a), for a period of from about 1 to about 24 hours at a temperature of from about 120° C. to about 210° C. under a vacuum of from about 0.02 mm Hg to about 10 mm Hg, the molar ratio of the fatty acid ester to the fatty acid starting material used in step (a) being from about 0.5:1 to about 1.5:1 (fatty ester:fatty acid).

2. A process according to claim 1 wherein the reaction time in step (a) is from about 5 to about 18 hours and the temperature is from about 150° C. to about 190° C.; the molar ratio of fatty acid: polyamine in step (a) is from about 0.75:1 to about 0.90:1; wherein after the fatty acid and the polyamine in step (a) have reacted, a vacuum of from about 0.02 mm Hg to about 10 mm Hg is drawn and the excess polyamine and water are removed via distillation for a period of from about 1 hour to about 6 hours, at a temperature of from about 125° C. to about 185° C.; wherein the reaction time in step (b) is from about 5 to about 22 hours and the temperature is from about 150° C. to about 190° C.; the reaction in step (b) is under a vacuum of from about 0.02 mm Hg to about 2 mm Hg; and wherein the molar ratio of fatty acid ester:fatty acid in step (b) is from about 0.75:1 to about 1.2:1.

3. A process for making a substituted imidazoline compound having the formula:

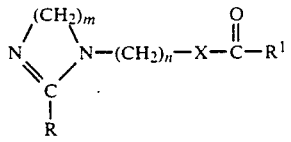

wherein R and $R^1$ are, independently, $C_{11}$-$C_{21}$ aliphatic hydrocarbon group, and m and n are, independently, from about 2 to about 6, and X is O, NH, or S, said process comprising the following steps:

(a) reacting a fatty acid of the formula RCOOH, where R is a $C_{11}$-$C_{21}$ aliphatic hydrocarbon group, with a polyamine having the formula $NH_2$—$(CH_2)_m$—NH—$(CH_2)_n$—X—H, wherein m and n are, independently, from about 2 to about 6, and X is O, NH, or S, for a period of from about 2 to about 24 hours at a temperature of from about 100° C. to about 210° C., the molar ratio of the fatty acid to the polyamine being from about 0.5:1 to about 1:1 (fatty acid: polyamine); and (b) reacting a triglyceride having the formula:

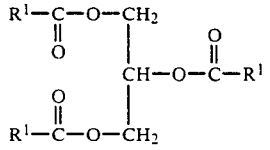

wherein $R^1$ is a $C_{11}$-$C_{21}$ aliphatic hydrocarbon group, with the mixture formed in step (a), for a period of from about 1 to about 24 hours at a temperature of from about 120° C. to about 210° C. under an atmosphere of air or an inert gas with a vacuum of from about 0.02 mm Hg to about 10 mm Hg, the molar ratio of the triglyceride to the fatty acid starting material used in step (a) being from about 0.5:1 to about 1.5:1 (triglyceride:fatty acid).

4. A process for preparing a reaction mixture containing substituted imidazoline compounds, which process comprises:

(a) forming a liquid reaction mixture containing (1) an acylating agent selected from fatty acids of the formula RCOOH, fatty acid halides of the formula (RCO)Y, fatty acid anhydrides of the formula $(RC(O))_2O$, or fatty acid short chain esters of the formula $RC(O)OR^1$, wherein, in said formulas, R is a $C_{11}$-$C_{21}$ aliphatic hydrocarbon group, $R^1$ is a $C_1$-$C_4$ alkyl group, and Y is a halide, and (2) a polyamine having the formula $NH_2$—$(CH_2)_m$—NH—$(CH_2)_n$—X—H, wherein m and n are, independently, integers from 2 to 6, and X is O, NH, or S, the molar ratio of the acylating agent to the polyamine ranging from about 0.5:1 to 1.0:1;

(b) maintaining said liquid reaction mixture at a temperature of from about 100° C. to 240° C. for a period of time sufficient to convert at least about 50 mole percent of the polyamine in the mixture to a mono-substituted imidazoline of the formula:

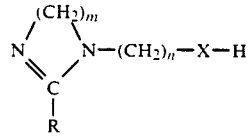

wherein R, m, n and X are as hereinbefore defined; and thereafter (c) adding to said liquid reaction mixture an esterifying agent selected from:

(i) fatty acid esters of the formula $R^1COOR^2$; and (ii) triglycerides of the formula:

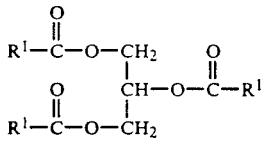

wherein, in both formulas, the $R^1$s are, independently, $C_{11}$-$C_{21}$ aliphatic groups and $R^2$ is a $C_1$-$C_4$ alkyl group;

said esterifying agent being present in an amount sufficient to provide a molar ratio of esterifying agent to acylating agent originally present of from about 0.5:1 to 1.5:1; and subsequently (d) maintaining said liquid reaction mixture at a temperature of from about 120° C. to 210° C. for a period of time sufficient to form a reaction mixture which contains one or more di-substituted imidazolines of the formula:

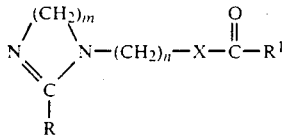

wherein R, $R^1$, m, n and X are as hereinbefore defined.

5. A process according to claim 4 wherein $R^2$ is methyl.

6. A process according to claim 5 wherein after the acylating agent and the polyamine have reacted in step (b), a vacuum of from about 0.02 mm Hg to about 10 mm Hg is drawn and the excess polyamine and water are removed via distillation for a period of from about 1 hour to about 6 hours, at a temperature of from about 125° C. to about 185° C.

7. A process according to claim 5 wherein the molar ratio of acylating agent:polyamine in step (a) is from about 0.75:1 to about 0.90:1.

8. A process according to claim 5 wherein in step (c) the molar ratio of the esterifying agent to acylating agent used in step (a) is from about 0.75:1 to about 1.2:1.

9. A process according to claim 5 wherein the reaction time in step (b) is from about 5 to about 18 hours and the temperature is from about 150° C. to about 190° C.

10. A process according to claim 5 wherein the reaction time in step (d) is from about 5 to about 22 hours and the temperature is from about 165° C. to about 190° C.

11. A process according to claim 5 wherein the reaction in step (d) is carried out under a vacuum of from about 0.2 mm Hg to about 2.0 mm Hg.

12. A process according to claim 5 wherein X is O or NH.

13. A process according to claim 12 wherein the polyamine in step (a) is $NH_2$—$CH_2$—$CH_2$—NH—$CH_2$—$CH_2$—$NH_2$ and R and $R^1$ are, independently, $C_{13}$-$C_{17}$ alkyl.

14. A process according to claim 12 wherein the polyamine is $NH_2$—$CH_2$—$CH_2$—NH—$CH_2$—$CH_2$—OH and R and $R^1$ are, independently, $C_{13}$—$C_{17}$ alkyl.

15. A process according to claim 14 wherein Step (d) is carried out under an inert atmosphere.

* * * * *

UNITED STATES PATENT AND TRADEMARK OFFICE
CERTIFICATE OF CORRECTION

PATENT NO. : 5,013,846

DATED : May 7, 1991

INVENTOR(S) : DARLENE R. WALLEY

It is certified that error appears in the above-identified patent and that said Letters Patent is hereby corrected as shown below:

Column 1, line 45, "active" should read --active.--

Column 12, line 52 "$NCH_2CH(CH_3(OC(O)C_{15}H_{31}Br$" should read --$[CH_3]_2[C_{18}H_{37}]^+NCH_2CH(CH_3)OC(O)C_{15}H_{31}Br^-$ --.

Column 12, line 54, "$[C_2H_5]_2[C_{17}H_{35}]^+NCH_2CH_2OC(O)C_{13}H_{27}Cl$" should read --$[C_2H_5]_2[C_{17}H_{35}]^+NCH_2CH_2OC(O)C_{13}H_{27}Cl^-$ --.

Column 12, lines 56-57, "$[C_2H_5][CH_3][C_{18}H_{37}]^+NCH_2CH_2OC(O)C_{14}H_{29}CH_3SO_4$" should read --$[C_2H_5][CH_3][C_{18}H_{37}]^+NCH_2CH_2OC(O)C_{14}H_{29}CH_3SO_4^-$ --.

Column 12, lines 58-59, "$[C_3H_7][C_2H_5][C_{16}H_{33}]^+NCH_2CH_2OC(O)C_{15}H_{31}Cl$" should read --$[C_3H_7][C_2H_5][C_{16}H_{33}]^+NCH_2CH_2OC(O)C_{15}H_{31}Cl^-$ --.

Column 12, lines 61-62, "$[iso\text{-}C_3H_7][CH_3][C_{18}H_{37}]^+NCH_2CH_2OC(O)C_{15}H_{31}I$" should read --$[iso\text{-}C_3H_7][CH_3][C_{18}H_{37}]^+NCH_2CH_2OC(O)C_{15}H_{31}I^-$ --.

Column 12, lines 63-64, "$[CH_3]_2[C_{18}H_{37}]^+NCH_2CH(OH)CH_2OC(O)C_{15}H_{31}Cl$" should read --$[CH_3]_2[C_{18}H_{37}]^+NCH_2CH(OH)CH_2OC(O)C_{15}H_{31}Cl^-$ --.

Column 12, lines 66-67, "$[C_2H_5]_2[C_{17}H_{35}]^+NCH_2CH(OH)CH_2OC(O)C_{14}H_{29}CH_3SO_4$" should read --$[C_2H_5]_2[C_{17}H_{35}]^+NCH_2CH(OH)CH_2OC(O)C_{14}H_{29}CH_3SO_4^-$ --.

UNITED STATES PATENT AND TRADEMARK OFFICE

CERTIFICATE OF CORRECTION

PATENT NO. : 5,013,846 Page 2 of 2

DATED : May 7, 1991

INVENTOR(S) : DARLENE R. WALLEY

It is certified that error appears in the above-identified patent and that said Letters Patent is hereby corrected as shown below:

Column 17, line 51, "20mi" should read --20ml--.

Column 18, line 18, "limiting.de" should read --limiting.--.

Column 19, line 40, "(1.5m" should read --(1.5 moles)--.

Column 22, line 46, "(RCO)Y" should read --RC(O)Y--.

Signed and Sealed this

Fifth Day of January, 1993

*Attest:*

DOUGLAS B. COMER

*Attesting Officer*

*Acting Commissioner of Patents and Trademarks*